United States Patent [19]

Hensel et al.

[11] Patent Number: 4,591,188

[45] Date of Patent: May 27, 1986

[54] ONE-WRITE PEGBOARD KEEPER PIN ASSEMBLY

[75] Inventors: John C. Hensel, Perkasie; Richard E. Penniman, Gwynedd Valley, both of Pa.

[73] Assignee: Safeguard Business Systems, Inc., Fort Washington, Pa.

[21] Appl. No.: 668,572

[22] Filed: Nov. 5, 1984

[51] Int. Cl.[4] ..... B41L 3/06; B42F 13/30; B42F 3/00

[52] U.S. Cl. ..... 282/29 B

[58] Field of Search ..... 282/29 B; 281/45, 25 R; 402/25, 46, 52, 54, 63–68; 24/150 R

[56] References Cited

U.S. PATENT DOCUMENTS

| | | | |
|---|---|---|---|
| 1,571,299 | 2/1926 | Pitt | 402/68 |
| 1,841,575 | 1/1932 | Dorsch | 402/63 |
| 2,548,104 | 4/1951 | Frison | 24/150 R |
| 2,901,796 | 9/1959 | Hope | 24/150 R |
| 3,083,714 | 4/1963 | Forter | 402/52 |
| 3,332,707 | 7/1967 | Bell | 282/29 |
| 4,307,972 | 12/1981 | Errichiello | 402/52 |

*Primary Examiner*—Paul A. Bell
*Assistant Examiner*—Paul M. Heyrana, Sr.
*Attorney, Agent, or Firm*—Howson and Howson

[57] ABSTRACT

A one-write check record keeping system having a writing panel on which a record sheet is placed underneath a series of checks is provided with a keeper pin which cooperates with a clamping latch assembly to enable the checks and record sheet to be removed and replaced periodically. The keeper pin is specially designed to cooperate with the panel and latch assembly in a manner which enables manufacturing economies to be realized.

1 Claim, 8 Drawing Figures

ONE-WRITE PEGBOARD KEEPER PIN ASSEMBLY

FIELD OF THE INVENTION

The present invention relates to record keeping systems for checking accounts, and more particularly, the present invention relates to improvements in pegboards of the type utilized in so-called one-write checking account record keeping systems.

BACKGROUND OF THE INVENTION

So-called one-write checking account record keeping systems have been marketed by the assignee of the present application for many years. Such a system comprises a journal having a writing panel on which is placed a check record sheet having a series of horizontal spaces and on which is laid an array of overlapped checks having pressure sensitive ink transfer strips on their undersides. The spaces on the record sheet and on the check strips are aligned by means of a series of alignment pins protruding upwardly along a vertical margin of the writing panel and engaging in holes in the record sheet and checks. A clamping assembly releasably secures the checks on the underlying record sheet and enables new checks to be installed and the record sheet to be removed and replaced periodically. Information, such as the payee, check number and check amount, written on the check is transferred directly to the underlying record sheet via the transfer strip.

For a more specific disclosure of the above-described system, reference is made to U.S. Pat. No. 3,332,707 owned by the assignee of the present application.

While the commercial form of the above-described one-write system functions entirely satisfactorily for its intended purpose, certain problems have been encountered in manufacturing the same. For example, a keeper pin is provided at each end of the array of alignment pins. The keeper pin is designed to cooperate with a finger actuated slide catch to effect the clamping action described. At present, each keeper pin has a conical tip with a transverse slot therebelow for engaging a spring-loaded slide which is biased into engagement therewith. The lower end of the keeper pin has an annular flange which engages the topside of the panel and a reduced diameter portion which extends through the panel. An elongated reinforcing strip underlies the row of alignment pins, and the reduced diameter portion of the keeper pin is swaged against the reinforcing strip to effect a permanent connection of the keeper pin to the panel.

Difficulties have been encountered in manufacturing the aforedescribed one-write journals economically because special steps must be taken to ensure that the slot in the keeper pin is aligned properly with the slide. Moreover, the configuration of the keeper pin itself renders it difficult, and hence expensive, to manufacture. Needless to say, a keeper pin design and assembly procedure which is less labor intensive and therefore more economical is highly desirable.

OBJECTS OF THE INVENTION

With the foregoing in mind, a primary object of the present invention is to improve the manufacturability of pegboards utilized in one-write check record keeping systems.

Another object of the present invention is to provide an improved keeper pin configuration and mounting arrangement for a pegboard panel used in a one-write check record keeping system.

A further object of the present invention is to provide a unique pegboard keeper pin and mounting arrangement which eliminates certain manufacturing problems encountered heretofore with prior art assemblies and which, therefore, enables manufacturing economies to be realized.

SUMMARY OF THE INVENTION

More specifically, the present invention provides a one-write check record keeping journal which can be manufactured economically. To this end, a novel keeper pin is mounted at opposite ends of an array of alignment pins to a writing surface panel on which a record sheet is placed underneath an array of overlapped checks. The checks and record sheet are releasably secured in position by a clamping assembly extending along an edge margin of the writing surface panel. The keeper pin has an enlarged head which is disposed underneath the panel and which terminates in a shaped tip on the topside of the panel. The keeper pin has an annular recess below its tip for releasably engaging a slide catch component of the clamping assembly. The keeper pin also has an undercut portion in registry with the panel for receiving a swaged topside portion of the panel. Preferably, the undercut portion of the keeper pin is roughened to enhance its connection to the panel and to prevent loosening.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
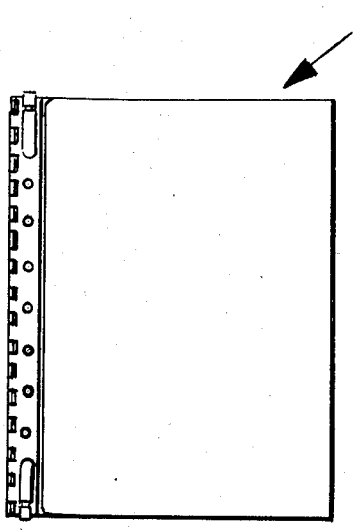
FIG. 1 is a plan view of a one-write check record keeping journal embodying the present invention.
Figure 2:
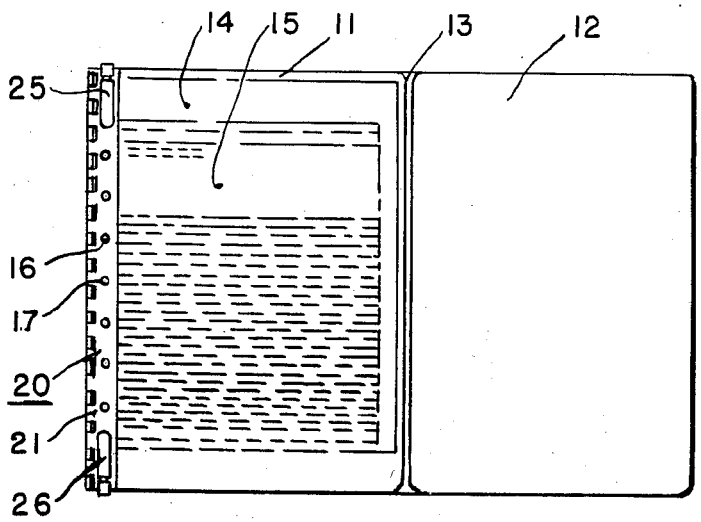
FIG. 2 is a view of the journal illustrated in FIG. 1 but in its open check writing position.

Referring now to the drawings, FIG. 1 illustrates a one-write checkbook journal 10 embodying the present invention. As best seen in FIG. 2, the journal 10 comprises a pair of writing surface panels 11 and 12 joined together by a hinge element 13 which enables the panels 11 and 12 to be opened into the usage configuration illustrated. In such configuration, a record sheet 14 is laid on the left panel 12, and a series of overlapped checks 15 are superimposed on the record sheet 14. Each check has an ink transfer strip on its reverse side for transferring information written directly on the check to the underlying record sheet 14. The checks 15 are aligned with the spaces on the record sheet 14 by means of alignment pins, such as the pins 16 and 17, which protrude upwardly from the panel 11 and extend through holes in the record sheet 14 and perforated stub portions along the left hand margins of the checks 15.

Figure 3:
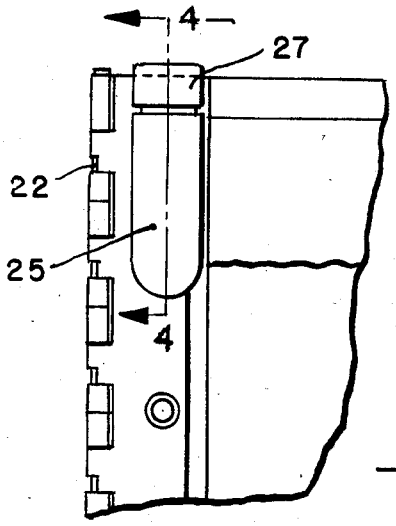
FIG. 3 is an enlarged fragmentary view of the upper left hand corner of the journal illustrated in FIG. 1.
Figure 4:
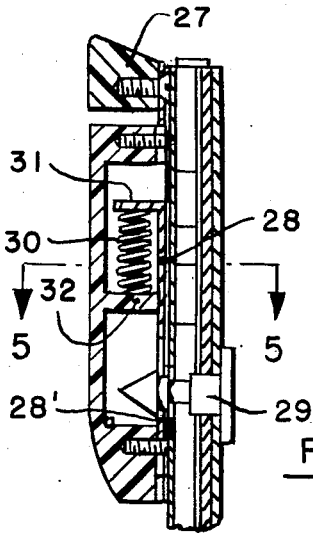
FIG. 4 is an enlarged sectional view taken on line 4—4 of FIG. 3.
Figure 8:
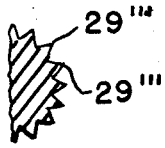
FIG. 8 is a fragmentary sectional view taken on line 8—8 of FIG. 7 to illustrate certain construction details of the keeper pin.
Figure 5:
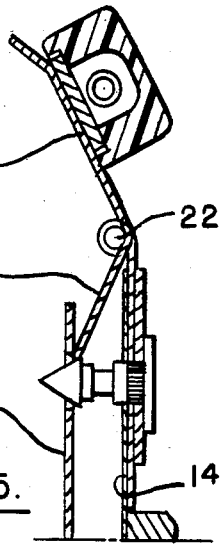
FIG. 5 is an enlarged sectional view taken on line 5—5 of FIG. 4 but illustrating the disposition of the elements in the course of ejecting check stubs.

For the purpose of securing the record sheet 14 and checks 15 on the panel 11, and of enabling the same to be periodically replaced, a clamping assembly 20 is provided. As best seen in FIGS. 3 and 4, the clamping assembly 20 comprises an elongated, relatively narrow clamping flange 21 which extends lengthwise of the panel 11 from top to bottom along its left hand margin. The clamping flange 21 is hingedly secured to the panel 11 by an elongated hinge pin 22 which extends through interdigitated bent portions of the clamping flange 21 and the panel 11. See FIG. 5. Thus, the clamping flange 21 can be pivoted about a longitudinal axis extending along the left hand edge of the panel 11, such as in the manner illustrated in FIG. 5. Preferably, an ejector strip 23 having turned portions interdigitated with the clamping flange 21 and panel 11 is pivotally mounted to the hinge pin 22 for facilitating the disengagement of check stubs from the writing panel 11 as illustrated in FIG. 5.

In order to releasably secure the clamping flange 21 in clamping relation with respect to the panel 11, a pair of slide catch assemblies 25 and 26 are mounted at opposite ends of the clamping flange 21. As best seen in FIG. 3, the upper slide catch assembly 25 has a finger actuator 27 connected by screws to a slide plate 28 slidable along the top surface of the clamping flange 21 into engagement with a keeper pin 29. As best seen in FIG. 4, the slide plate 28 is biased into engagement with the keeper pin 29 by a compression spring 30 engaged between an upturned flange 31 on the slide plate 28 and a partition 32 in a molded cover fastened to the clamping flange 21. Thus, depression of the finger actuator 27 axially inward (downward in FIGS. 3 an 4) causes the slide plate 28 to disengage the keeper pin 29 to enable the clamping flange 21 to be pivoted upwardly with respect to the writing panel 11 such as in the manner illustrated in FIG. 5 for causing the ejector 23 to lift check stub margins 15 from the underlying record sheet 14.

As described thus far, the clamping assembly 26 is of conventional construction. Heretofore, the keeper pin which engaged the slide plate 28 had a transverse slot which received a marginal edge 28' of the slide plate 28. As discussed heretofore, difficulties were encountered in manufacturing pegboards of this design because of the need to align the keeper pin slot prior to mounting it permanently to the panel 11, and because the configuration of the keeper pin itself made it difficult to manufacture on high speed production equipment. The present invention overcomes these limitations.

Figure 6:
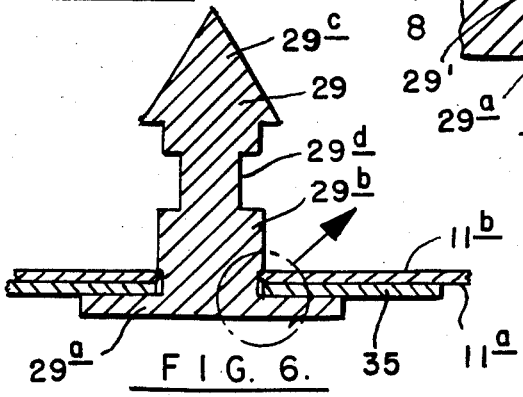
FIG. 6 is a greatly enlarged sectional view of the keeper pin illustrated in FIG. 5.

To this end, as best seen in FIG. 6, a keeper pin 29 having a novel configuration is provided for cooperating with the panel 11 in such a manner as to enable manufacturing economies to be realized. As best seen in FIG. 6, the keeper pin 29 has a circular head **29*a* disposed adjacent the underside 11*a* of the panel 11 and separated therefrom by a thin reinforcing strip 35. The keeper pin 29 has a shank 29*b* protruding upwardly from the head 29*a* and terminating in a conical tip 29*c*. The keeper pin 29 has an annular peripheral recess 29*d* located below the conical tip 29*c* and above the topside 11*b* of the panel 11. The recess 29*d* receives the marginal edge 28' of the slide plate 28 when the slide plate is positioned in the manner illustrated in FIG. 4 with the clamping assembly 20 in operative clamping engagement. The recess 29*d* extends completely around the periphery of the shank 29*b* of the keeper pin 29. As a result of this construction, the keeper pin itself is less expensive to fabricate, and there is no need to align the keeper pin 29 with respect to the slide plate edge 28'** during assembly.

Figure 7:
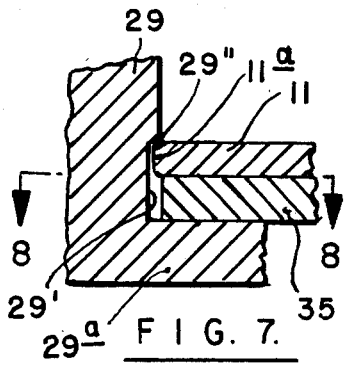
FIG. 7 is an even more greatly enlarged view of the manner in which the keeper pin of FIG. 6 is secured to the writing surface panel.

The keeper pin 29 is securely fastened to the writing surface panel 11. To this end, as best seen in FIG. 7, the keeper pin 29 has an undercut portion 29' defined between a shoulder 29'' and the upper surface of the keeper pin head **29*a*. The undercut portion 29' is aligned with the panel 11 and its underlying reinforcing strip 35. Preferably, the undercut portion 29' is roughened by being provided with a series of circumferentially spaced teeth 29''' extending axially between the shoulder 29'' and the head 29*a*. The writing panel 11 and its underlying reinforcing strip 35 are provided with holes of a diameter sufficient to pass the tip 29*c* of the keeper pin 29** vertically during initial assembly.

The keeper pin 29 is securely fastened to the panel 11. For this purpose, a portion **11*c* of the panel 11 surrounding the keeper pin 29 is swaged into the undercut portion 29' and engages the shoulder 29'' thereof. This locking action is achieved by supporting the keeper pin head 29*a* from below while simultaneously causing a swaging tool surrounding the keeper pin 29 to move downward in close proximity with the pin shank 29*b* for engaging the topside of the panel 11 to cause a portion 11*c* thereof to flow into the undercut portion 29'. The swaged panel portion 11*c* flows into the spaces between the teeth 29''' and cooperates therewith to prevent the keeper pin 29 from rotating and thus preventing the keeper pin 29** from loosening in use.

By way of example, and not by way of limitation, the keeper pin 29 is preferably fabricated of stainless steel and the panel 11 of aluminum. The reinforcing strip 35 between the panel 11 and the keeper pin head **29*a*** is preferably cold rolled steel.

In view of the foregoing, it should be apparent that the present invention now provides an improved keeper pin configuration which can be fabricated economically. The present invention also provides means for mounting the keeper pin to a writing panel in an efficient manner. In addition, the keeper pin of the present invention is securely fastened to the writing panel by a simple yet effective mechanism which resists loosening.

While a preferred embodiment of the present invention has been described in detail, various modifications, alterations and changes may be made without departing from the spirit and scope of the present invention as defined in the appended claims.

We claim:

1. In a check writing journal comprising a panel having a topside with an edge margin and a series of alignment pegs protruding in spaced relation from the panel margin for engaging in similarly spaced holes in a record sheet and overlying checks to arrange each check in proper alignment with respect to spaces on the record sheet; and means for releasably clamping the checks and record sheet to the panel, including a clamping flange adapted to overlie the panel edge margin, hinge means pivotally connecting the clamping flange to the panel, a slide catch carried at each end of the clamping flange, and a keeper pin carried by the panel for releasably engaging the slide catch, the improvement wherein said keeper pin has a head disposed below the panel and a cylindrical shank projecting upwardly therefrom beyond the topside of the panel and terminating in a shaped tip, said shank having an annular recess located below said tip for releasably receiving said slide catch when said clamping flange is in clamping relation with said panel, said shank also having a shallow undercut portion in registry with said panel, said shank further having in its undercut portion a plurality of circumferentially spaced teeth providing a roughened peripheral surface, said panel having a topside portion surrounding said pin swaged into said undercut portion of said shank and into engagement with said teeth to fasten said pin permanently to said panel.

* * * * *